US005626335A

United States Patent [19]

Radwanski et al.

[11] Patent Number: 5,626,335

[45] Date of Patent: May 6, 1997

[54] VERTICAL LIFT SYSTEM FOR DELIVERING SHEETS IN STACKS

[75] Inventors: Raymond E. Radwanski, Ladysmith; John J. Kondratuk, Kennan; Carl R. Marschke, Phillips; James A. Volrath, Prentice, all of Wis.

[73] Assignee: Marquip, Inc., Phillips, Wis.

[21] Appl. No.: 595,048

[22] Filed: Feb. 1, 1996

[51] Int. Cl.[6] ..... B65H 1/30

[52] U.S. Cl. ..... 271/159; 271/158; 414/795.8; 414/795.3

[58] Field of Search ..... 271/157, 158, 271/159; 414/795.8, 796.7, 790.8, 795.3

[56] References Cited

U.S. PATENT DOCUMENTS 2,336,839 12/1943 Blackstone ..... 271/158 X 2,654,603 10/1953 Williams et al. ..... 271/159

3,180,638 4/1965 Meylan ..... 271/159

4,052,051 10/1977 Mersereau et al. ..... 271/159 X

*Primary Examiner*—Boris Milef

*Attorney, Agent, or Firm*—Andrus, Sceales, Starke & Sawall

[57] ABSTRACT

A system for continuously delivering sheets which are provided in successive discrete stacks includes a stack infeed conveyor which includes a cushioned upper hold-down belt synchronized to operate with a lower supporting infeed conveyor and to provide stability to stacks of relatively short sheets. A continuous lift apparatus receives successive stacks from the infeed system and utilizes a dual lift apparatus to provide the continuous delivery of stacked sheets which are individually fed from the top of the continuously ascending stack.

4 Claims, 4 Drawing Sheets

44
36
37
10
24
27
18
17
38
S
S
16
14
20
13
15
21
11
25
22

39
37
27
16
17
38
43
S
S
14
40
21
13
22

39
36
10
24
27
44
18
16
43
S
38
30
S
S
32
31
20
14
21
11
15
13
25
40

FIG. 7
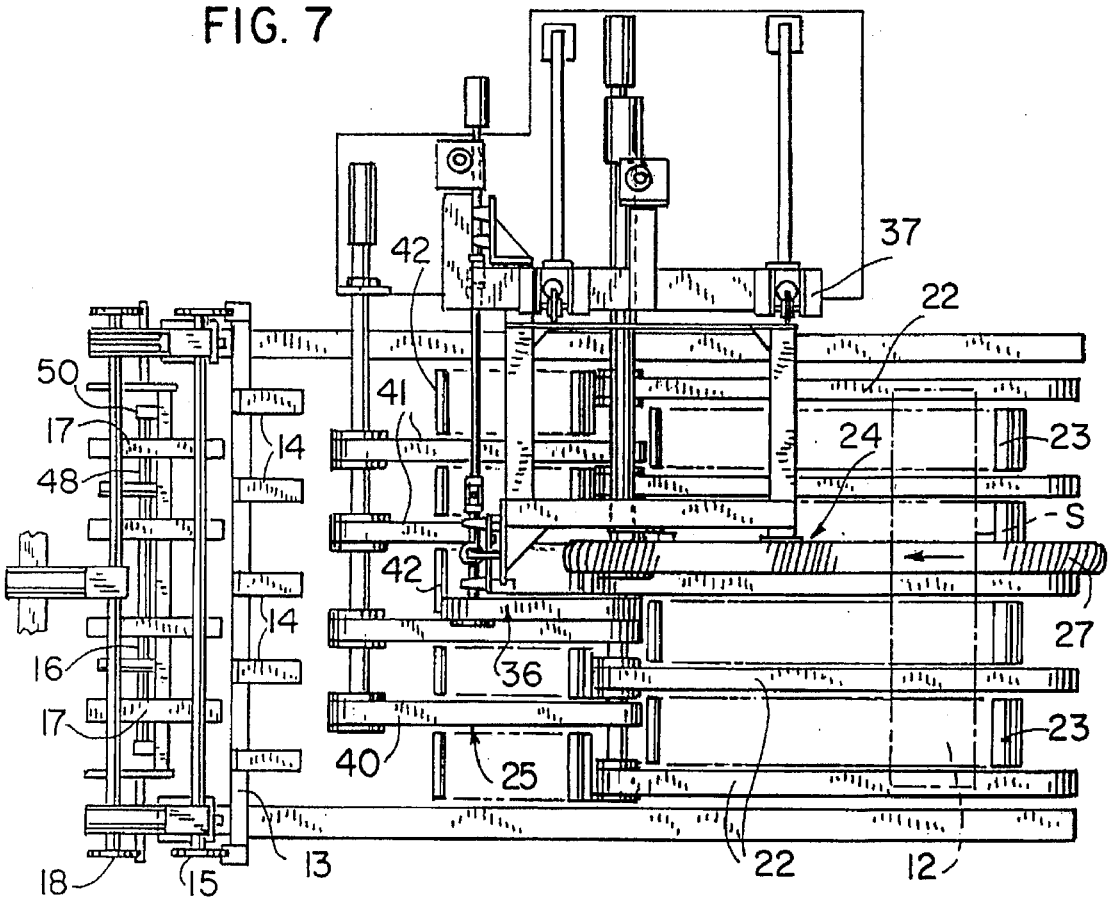
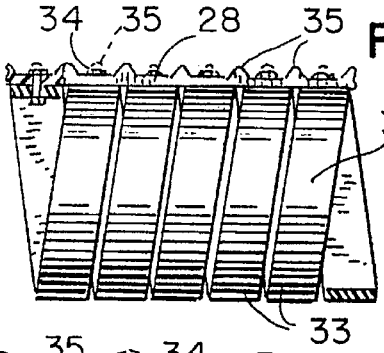
FIG. 8
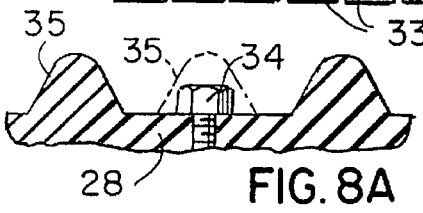
FIG. 8A
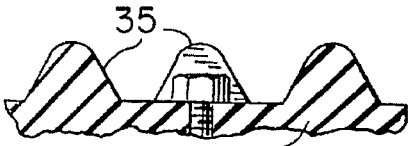
FIG. 8B
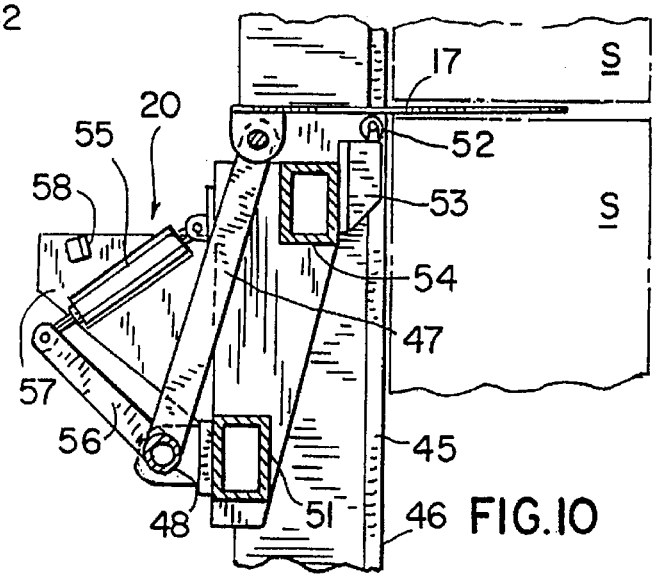
FIG. 10

VERTICAL LIFT SYSTEM FOR DELIVERING SHEETS IN STACKS

BACKGROUND OF THE INVENTION

The present invention pertains to an apparatus and method for continuously delivering sheets which are provided in successive stacks and, more particularly, to a system for delivering sheets in a continuous vertically ascending master stack from the top of which sheets are successively fed for continued processing.

In many sheet feeding systems, sheets are delivered to the system in discrete stacks, but it is desirable or even necessary to provide the continuous delivery of sheets in a stack so that individual sheets may be fed from the bottom of the descending stack or from the top of the ascending stack. In the former, discrete stacks may be continuously loaded into a feed hopper by any of a number of convenient means and the stack allowed to descend by gravity as sheets are fed from the bottom. In the latter situation, the continuous delivery of sheets in discrete stacks to form a continuously ascending stack from the top of which the sheets are fed is typically moire difficult. Nevertheless, sheet handling arid converting systems may inherently dictate the use of an ascending stack feeder.

It is the object of the present invention, therefore, to provide a lift apparatus and method for continuously delivering sheets which are supplied in successive stacks and, in particular, such a system which is especially adapted to handle solid fiberboard sheets.

SUMMARY OF THE INVENTION

The apparatus of the present invention comprises a continuous lift for the delivery of sheets which are provided in successive discrete stacks and includes a first lift which is defined by a plurality of spaced first forks adapted to receive and support a stack of sheets, first lift drive means for moving the first lift at a variable speed including an upward first speed in a generally vertical path, a second lift defined by a plurality of spaced second forks, means for moving the second forks between an operative position supporting a stack of sheets and an inoperative position withdrawn from the supporting position, second lift drive means for moving the second lift when in the operative position upwardly along a portion of said vertical path at said first speed and in the inoperative position vertically downwardly, and drive control means for cycling the first and second lifts to provide continuous lifting support of the stack by at least one of said pluralities of first and second forks and constant upward movement of the top of the stack at the first speed.

In the presently preferred embodiment, the moving means is operative to insert the second forks between the first forks to establish the operative position of the former. The drive control means is preferably responsive to movement of the second forks into the operative position to provide downward movement of the first lift to the infeed position at a speed greater than said first speed. Further, the drive control means is operative to provide initial upward movement of the first lift from the infeed station at a speed greater than said first speed.

The present invention also includes a method for continuously delivering sheets which are provided in successive stacks comprising the steps of: delivering a first stack onto a plurality of first forks positioned at a lower infeed position; lifting said first stack in a vertical path on said first forks at the first speed; inserting a plurality of second forks between the first forks at a lower intermediate position and into the vertical path in supporting contact with the stack; lifting the stack on the second forks at the first speed; lowering the first forks to the infeed position at a speed greater than said first speed; delivering a second stack onto the first forks at the infeed position; lifting the second stack on the first forks at an initial speed greater than the first speed to a point of engagement between the top of the second stack and the underside of the second forks; slowing the first forks to the first speed and continuing to lift the first and second stacks at the first speed; withdrawing and returning the second forks to the lower intermediate position; and, repeating the process for a third and subsequent stacks.

The system of the present invention also includes an upper holddown conveyor apparatus adapted to be used with a lower feed conveyor which carries a vertical stack of sheets, such as into the lower infeed position of the previously described continuous lift apparatus, the holddown conveyor apparatus comprising a continuous support belt which includes a generally horizontal active run extending between upstream and downstream pulleys, and a narrow continuous flexible band which is formed into a helix and attached at each helical winding to the outer face of the support belt, the portion of the helical band which extends along the active run providing cushioned engagement with the top of the stack.

In the preferred embodiment of the holddown conveyor apparatus, the support belt has a smooth outer face and a toothed inner face, and the pulleys comprise toothed sprockets adapted to operatively engage the toothed inner face of the support belt. The toothed inner face of the support belt preferably has a tooth pitch which is twice the pitch of the sprocket teeth. The apparatus includes means for driving the feed conveyor and the holddown conveyor at the same linear speed.

BRIEF DESCRIPTION OF THE DRAWINGS

FIG. 7 is a top plan view of the apparatus shown in FIGS. 1–6.

FIG. 8 is a detailed side view, partly in section, of a portion of the holddown conveyor of the present invention.

FIGS. 8A and 8B are enlarged details of FIG. 8 showing alternate embodiments of the belt connection.

FIG. 10 is an enlarged sectional detail taken on line 10–10 of FIG. 9 showing the operative position of the secondary lift.

DETAILED DESCRIPTION OF THE PREFERRED EMBODIMENT

Referring initially to FIGS. 1–7, the system of the present invention is specially adapted to handle stacks S of sheets of relatively stiff materials, such as solid fiberboard. The stacks S are supplied in a line to an infeed conveyor system 10 from which they are individually and sequentially fed onto a continuous lift apparatus 11 in a manner whereby a continuous ascending stack is provided from which top sheets are individually fed for further downstream processing. As may be best seen in the top plan view of FIG. 7, the sheets 12 have a short length in the machine direction and a long width in the cross machine direction. For example, the maximum length of the sheets 12 may be 18 inches (about 45 cm), while the sheet width may be 60 inches (about 152 cm) or more. Sheets having a length as short as 6 inches (about 15 cm) may also be handled by the system of the present invention. However, the stacks S of sheets with relatively short lengths create problems of inherent instability, particularly when handling stacks having a height as great as about 5 feet (1.5 m).

Figure 1:
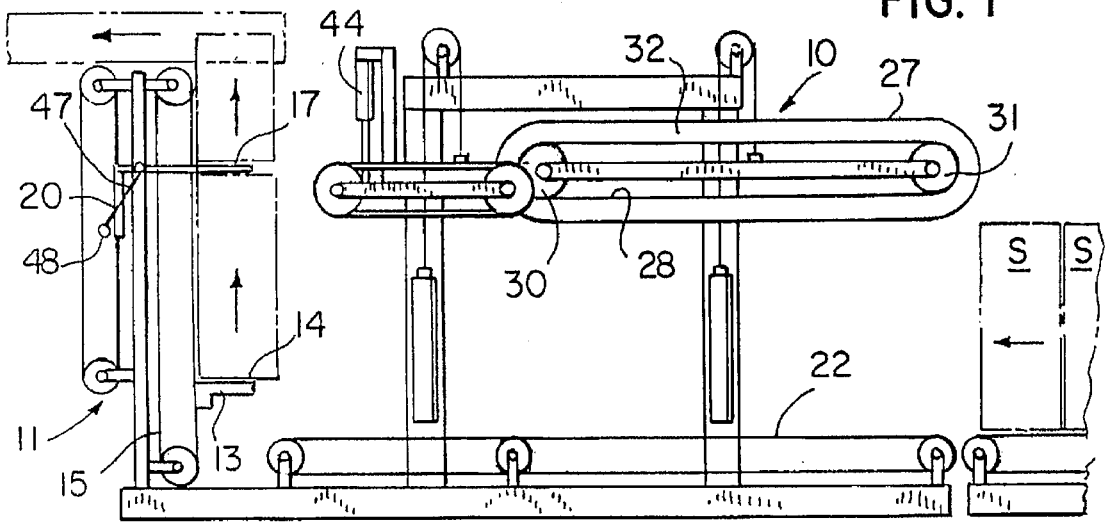
FIG. 1 is a schematic side elevation view of the apparatus of the present invention in an intermediate stage of operation.

In the schematic views of FIGS. 1–6, the system is shown in various intermediate stages of operation which, beginning with FIG. 1, shows the completion in the lift apparatus 11 of the last two stacks S of one order and the upstream entry into the infeed conveyor system 10 of the stacks S comprising a new order. With slight variations in the operation of components of the lift apparatus 11, as will be explained hereinafter, FIGS. 1–3 could as well represent the continued processing of stacks S common to a single order.

The continuous lift apparatus 11 includes a first main lift 13 comprising a plurality of laterally spaced coplanar first forks 14 which are connected for reciprocal vertical movement to a first cable lift mechanism 15. The main lift 13 operates between a lowermost infeed position, shown in FIG. 1 and an uppermost outfeed position (not shown) high enough on the lift mechanism 15 to permit the lowermost sheet in the final stack of an order to be fed horizontally therefrom for further downstream processing.

The continuous lift apparatus 11 also includes an auxiliary second lift 16 comprising a plurality of second forks which,, in an operative position, extend between the first forks 14 to support and provide intermediate upward movement of the stack, as will be described. The second lift is mounted for vertical reciprocal movement on a second cable lift mechanism 18 and includes a fork operating mechanism 20 which allows the second forks to be moved between the operative position and a rearward inoperative position (shown schematically in FIG. 2) withdrawn from the path of vertical stack movement. The auxiliary stack support provided by the second lift 16 requires vertical limits of operation which are above the lowermost infeed position of the first main lift 13 and below the uppermost position of the first lift.

The incoming stacks S are preferably carried through the infeed conveyor system 10 in abutting face-to-face relation from a suitable upstream delivery mechanism 21, such as a horizontal conveyor. The infeed conveyor system 10 includes a plurality of parallel laterally spaced belt conveyors 22 operating together with a common drive and between each pair of which is positioned a stack supporting main roller conveyor 23. Associated with the main belt conveyors 22 is an upper holddown conveyor 24 which provides unique cushioned engagement of the upper surface is of the stacks and helps maintain the stability thereof as the stacks are fed into the continuous lift apparatus 11. Details of the construction and operation of the holddown conveyor will be described below.

Figure 2:
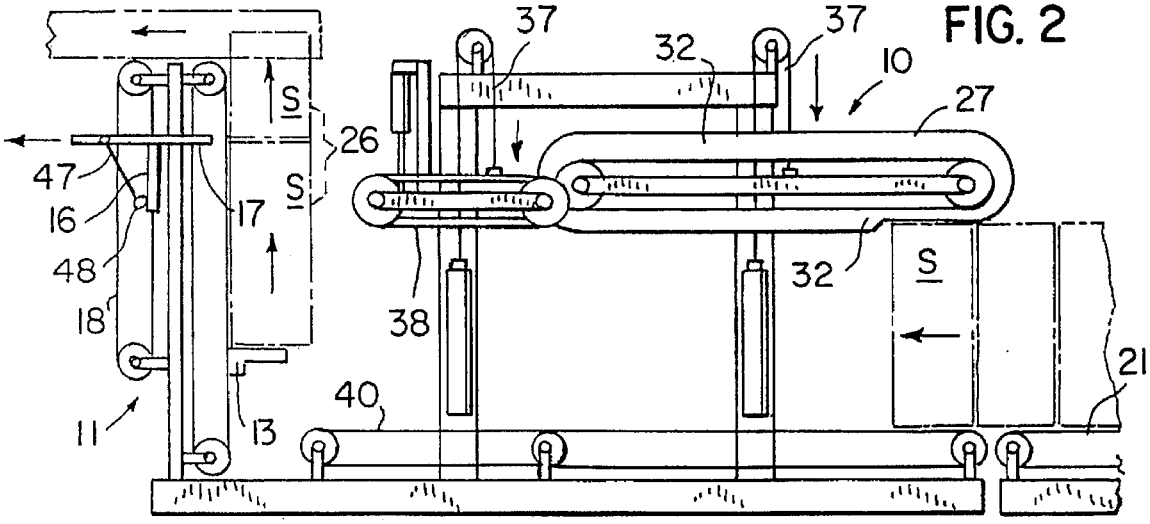
FIGS. 2–6 are schematic side elevations similar to FIG. 1 showing the continuing sequence of operation.
Figure 4:
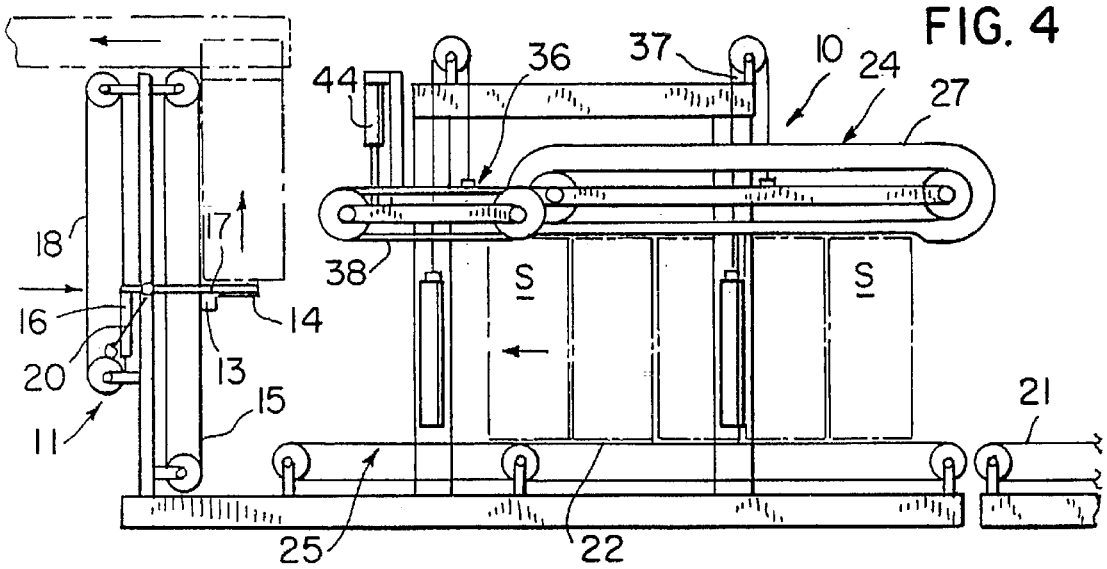
Figure 5:
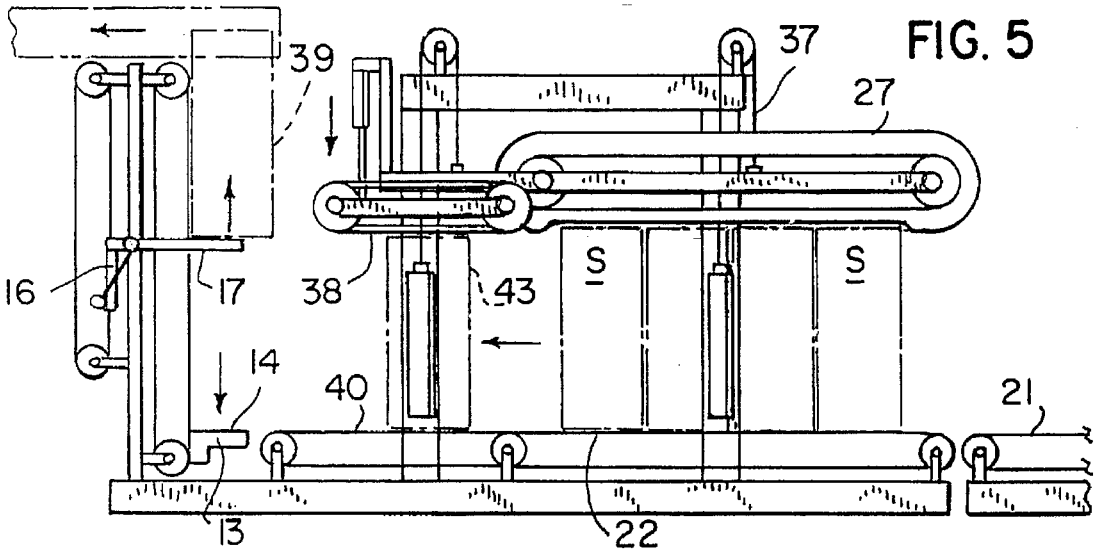
Figure 6:
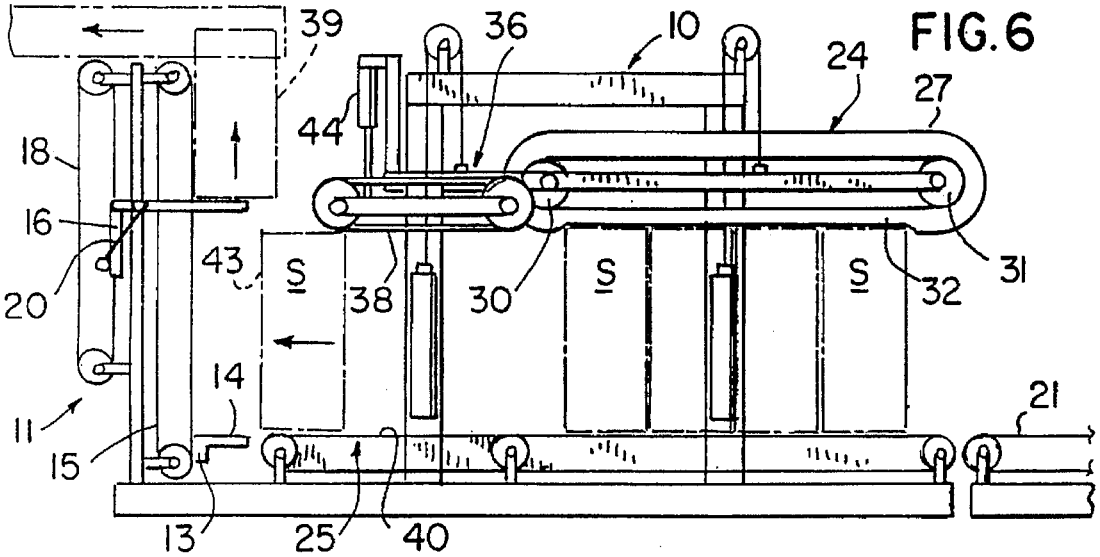

If the system in FIGS. 1–6 is viewed first as showing the delivery of the last two stacks of an order, then such order completion may be briefly described with reference to an operational sequence shown successively in FIGS. 6, 1 and 2 (ignoring for the moment the abutting stacks S on the main belt conveyors 22 of the infeed conveyor system 10). In FIG. 6, the last or lowermost stack is shown about to be released from an indexing conveyor section 25 onto the forks 14 of the main first lift 13. The second to last or uppermost stack, meanwhile, is being raised slowing upwardly on the forks 17 of the auxiliary second lift 16 at a first speed which is the delivery speed at which sheets are individually fed from the top of the stack in a horizontal downstream direction as indicated by the arrow at the top of the lift apparatus 11. As soon as the lowermost or last stack of the order is deposited on the main first lift 13, the lift is accelerated upwardly at a speed substantially greater than the delivery speed of the upper stack, until the upper end of the lower stack reaches the underside of the forks 17 of the auxiliary lift 16, as shown in FIG. 1. Just prior to contact, the speed of the lower main lift 13 is slowed to the desired delivery speed such that the auxiliary lift 16 and the main lift 13 are moving vertically upwardly at the same speed. Then the auxiliary second forks 17 are withdrawn and the main lift 13 continues the upward movement of the combined master stack 26, as shown in FIG. 2. As indicated previously, the main first lift 13 is adapted to move fully to the top of the cable lift mechanism 15 so that the last sheet in the stack for the order being processed is delivered for horizontal takeoff and downstream feed.

In processing a full order, a row of abutting stacks S is brought into the infeed conveyor system 10 by the upstream delivery mechanism 21, as shown schematically in FIGS. 1 and 2. Referring also to FIGS. 7 and 8, the upper holddown conveyor 24 includes a unique cushioning holddown belt 27 which operates in sync and at the same speed as the lower main belt conveyors 22 to carry the row of incoming stacks to the continuous lift apparatus 11. The holddown belt 27 includes a continuous support belt which operates around a driven head pulley 30 and an idler tail pulley 31 to define a lower generally horizontal active run extending therebetween. The support belt 27 is preferably a toothed timing belt, as best seen in FIG. 8, adapted to operate about correspondingly toothed pulleys 30 and 31, as generally known in the art.

A narrow continuous flexible band is attached to the smooth outer face of the support belt 28 after first being wound into a helix. Each helical winding 33 of the band 32 is attached to the belt 28 with a suitable connector, such as a rivet or a nut and bolt 34. As shown, the pitch of the helix may be approximately twice the pitch of the belt 28 and pulleys 30,31. To make room for the connectors 34, every other tooth 35 on the support belt 28 may be cut away, as shown in FIG. 8A. Sufficient driving engagement between the driven head pulley 30 and the modified support belt 28 may still be attained. Alternately, as shown in FIG. 8B, alternate teeth 35 on the belt could be centrally notched to make room for the head of the connector 34, thereby retaining most of the tooth for engagement by the teeth of the drive sprocket or pulley 30. The flexible helical band 32 may comprise a piece of conventional reinforced rubber belting or the like. The easily deformable helical winding 33 provides stabilizing engagement with the top of the stacks S in the row, does not mark or otherwise damage the top sheets, and readily conforms to occasional variations in height from one stack to another in a row.

The upper holddown conveyor 24 is connected at its downstream end to an upper indexing conveyor 36 which forms the upper portion of the indexing conveyor section 25. Both the holddown conveyor 24 and indexing conveyor 36 are vertically adjustable with a common vertical adjustment mechanism 37. Initial vertical adjustment places the flexible helical winding 33 of the holddown belt 27 into stabilizing cushioned engagement with the tops of the incoming stacks. Vertical adjustment does not have to be precise and the flexibility of the helical winding 33 is sufficient to easily accommodate variations in stack height of at least 2 inches (about 5 cm). The upper indexing conveyor 36 comprises a single drive belt 38 which is independently driven and is adapted to take one stack at a time from the row beneath the upper holddown conveyor 24 and move it onto the main first lift 13. The indexing conveyor section 25 includes a lower indexing conveyor 40 which is driven in synchronization with the upper indexing conveyor 36 and at the same speed. As is best seen in FIG. 7, the lower indexing conveyor 40 is comprised of a plurality of parallel, laterally spaced short belt conveyors 41, on both sides of each of which are positioned short roller conveyor sections 42. The short roller conveyor sections extend approximately the same distance downstream as the upper indexing conveyor 36, with the short belt conveyors 41 extending further downstream to a head end just adjacent the ends of the forks 14 for the main lift 13.

Figure 3:
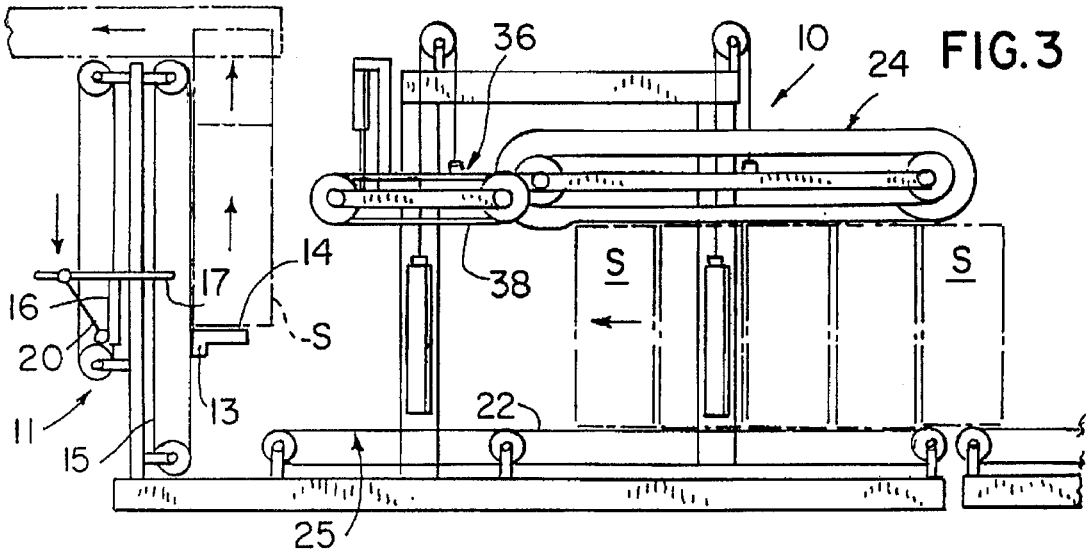

If, as described with respect to the preceding example and referring to FIG. 3, the master stack 26 on the main first lift 13 represents the end of an order, then the stack will remain on the lift to the top of the lift mechanism 15 until the last sheet at the bottom of the stack reaches the top and is fed horizontally in the downstream direction. However, if the system in the FIG. 3 position is to be operated to continuously deliver the sheets in the stacks held in the infeed system 10, the operation is as follows. The auxiliary second lift 16, whose forks 17 had been withdrawn from the stack in FIG. 2, descends rapidly to its lowermost ready position in FIG. 3 as the main lift 13 continues to move upwardly at the stack delivery speed. In FIG. 4, the forks of the main lift 13 have reached the level of the forks 17 of the auxiliary lift 16 at which time the fork operating mechanism 20 is activated to insert the forks 17 into the spaces between the forks 14 and immediately below the bottom of the stack. The second cable lift mechanism 18 is simultaneously activated to continue lifting the stack at the same speed as the upward movement of the main lift 13 which is simultaneously reversed and returned to its lower infeed position at a speed substantially greater than the upward stack delivery speed (as shown in FIG. 5). At this time, the infeed conveyor 10 is operated to bring the next following stack 43 onto the lower indexing conveyor 40 and the drive belt 38 of the upper indexing conveyor 36 is brought vertically downwardly onto the stack by operation of a pneumatic cylinder 44. The indexing conveyor 25 is operated to carry the stack 43 toward the main lift 13 in the infeed position while the lead stack 39 continues upwardly at the stack delivery speed so that, as shown in FIG. 6, the auxiliary lift 16 and lower end of the lead stack 39 have cleared the path of the incoming following stack 43.

As soon as the next following stack 43 is in position on the first forks of the main lift 13 the latter is accelerated at a vertical upward speed substantially in excess of the normal upward delivery speed at which the second lift 16 is carrying the lead stack 39. When the top of the trailing stack 43 approaches the underside of the second forks 17, the speed of the main lift is slowed and, when engagement occurs, both lifts continue upward movement at the stack delivery speed and the auxiliary forks 17 are immediately withdrawn from between the stacks, as shown in the transition from FIG. 1 to FIG. 2. With the forks retracted, the auxiliary lift 16 is cycled down to its lowermost position in FIG. 3 to await passage of the lower end of the following stack 43 ascending on the main lift 13. Continuing on to FIG. 4, as soon as the forks 14 of the main lift reach the level of the auxiliary forks 17, the latter are reinserted into the spaces between the first forks and the second lift 16 assumes vertical ascending movement of the stack at the established delivery rate. Meanwhile, and continuing onto FIG. 5, the main lift 13 cycles down at high speed to its lowermost infeed position to await the indexed delivery of the next stack.

Figure 11:
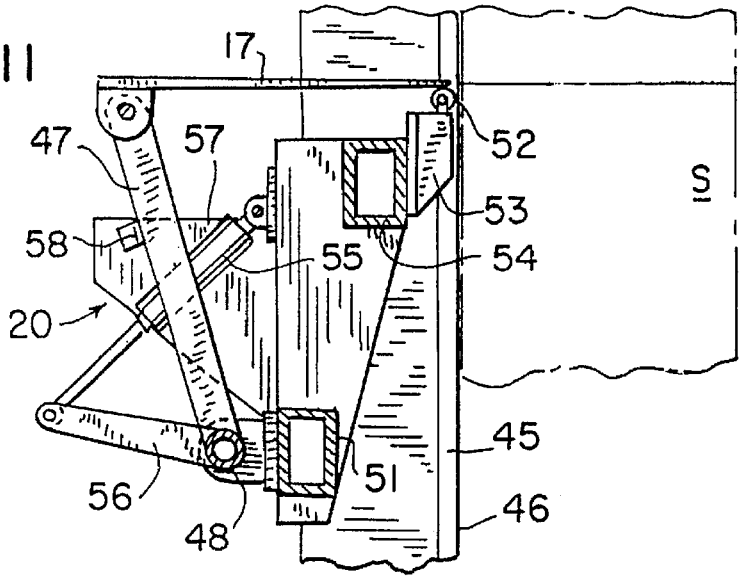
FIG. 11 is a sectional detail similar to FIG. 10 showing the inoperative position of the secondary lift.
Figure 9:
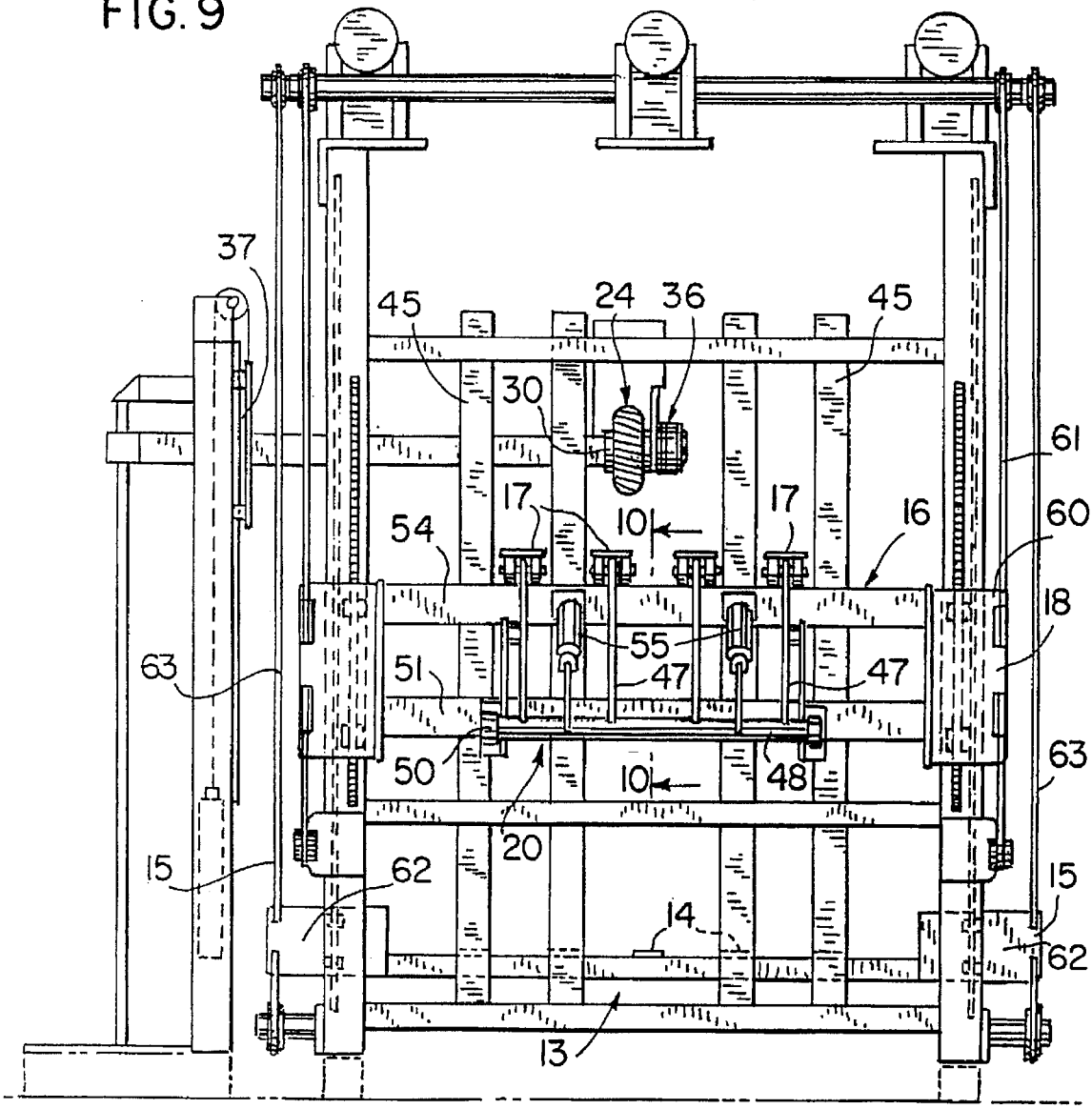
FIG. 9 is an end elevation of the apparatus shown in FIG. 7 viewed in the lapstream direction.

To help alleviate problems of stack instability, it is preferred that the continuous lift apparatus 11 be tilted slightly in the downstream direction so the stacks being delivered thereon have a tendency to lean against the lift apparatus. Specifically and referring also to FIGS. 9–11, a substantially vertical stack engaging face of the lift is defined by four laterally spaced stationary slide plates 45 which provide coplanar outer faces against which the stacks rest and slide vertically. In the preferred embodiment, the slide plates are positioned with the outer faces defining an upwardly divergent angle of about 3° with respect to the vertical. Similarly, the main lift forks 14 and auxiliary lift forks 17 are positioned perpendicularly with respect to the faces of the slide plates such that both sets of forks slant upwardly from the horizontal at approximately the same 3° angle.

Apart from their vertical reciprocal movement on the main lift 13, the main lift forks 14 have no independent movement. The second forks 17 on the auxiliary lift, however, must utilize the fork operating mechanism 20 to provide insertion under a rising stack and withdrawal from between the two stacks forming an ascending master stack. Each of the forks 17 includes a pivotal attachment at its rear end to a pivot arm 47. The opposite lower end of each pivot arm is rigidly attached to a common horizontal pivot tube 48 rotatably supported in a pair of end bearings 50 which are, in turn, attached to a lower horizontal frame member 51. Each fork 17 is supported in its path of generally horizontal reciprocal movement on a pair of cam wheels 52 mounted on a support bracket 53 which, in turn, is attached to an upper horizontal frame member 54. Common simultaneous operation of all four forks 17 is provided by a pair of fluid cylinders 55 each of which has its cylinder end pivotally attached to the upper frame member 54 and its rod end pivotally attached to a second pivot arm 56. The lower ends of the second pivot arms are rigidly attached to the pivot tube 48 such that extension of the fluid cylinders 55 from the active support position of the forks in FIG. 10 causes rotation of the pivot tube 48 and concomitant withdrawal of the forks to the inoperative position shown in FIG. 11. It will be appreciated that the rotation of the pivot arms 47 with the rotation of the pivot tube 48 will cause their opposite upper ends which are pivotally attached to the forks to rotate in a circular arc. Such rotation of the pivot arms 47 between the FIG. 10 and FIG. 11 positions will result in a slight raising of the pivotally attached ends of the forks as they traverse that arc. Such movement, however, has no adverse affect on proper functioning of the fork operating mechanism 20. A side plate 57 is mounted between the upper and lower horizontal frame members 54 and 51 adjacent each of the outermost fork pivot arms 47. Each side plate includes a fixed arm stop 58 positioned to be engaged by an edge of the associated pivot arm 47 to limit retracted movement of the forks beyond the point where the free ends thereof are supported on the cam wheels 52.

The entire fork operating mechanism 20 must necessarily be attached to the second cable lift mechanism 18 to provide the required vertical reciprocal movement. Each of the lower and upper horizontal frame members 51 and 54 is attached at its opposite ends to a cable mounting bracket 60 which, in turn, is attached to one of the vertical cables 61 of the second cable lift mechanism 18. Similarly, opposite ends of the first main lift 13 are attached to brackets 62 which, in turn, are attached to the cables 63 of the first cable lift mechanism 15.

I claim:

1. A lift apparatus for the continuous delivery of sheets provided in successive stacks comprising:

a first lift defined by a plurality of spaced first forks adapted to receive and support a stack of sheets at a lower infeed position;

first lift drive means for moving the first lift at a variable speed in a generally vertical path including an upward first speed;

a second lift defined by a plurality of spaced second forks;

means for moving said second forks between an operative position supporting a stack of sheets and an inoperative position withdrawn from the supporting position;

saidmeans for moving the second forks including means for pivotally attaching each of said second forks to the end of one of a plurality of pivot arms, means for rigidly attaching the opposite ends of the pivot arms to a common rotatable pivot tube, means for reciprocally rotating the pivot tube to move said second forks between the operative and inoperative positions, and bearing means for supporting the free ends of the second forks and maintaining said second forks in a generally horizontal plane of movement;

second lift drive means for moving the second lift in the operative position upwardly along a portion of said vertical path at said first speed and in the inoperative position vertically downwardly; and, drive control means for cycling said first and second lifts to provide continuous lifting support of the stack by at least one of said plurality of first and second forks and constant upward movement of the top of the stack at said first speed.

2. The apparatus as set forth in claim 1 wherein the moving means is operative to insert the second forks between said first forks to establish the operative position of said second forks.

3. The apparatus as set forth in claim 2 wherein said drive control means is operative in response to upward movement of said first forks to the level of said second forks to provide movement of said second forks to the operative position and to provide reverse downward movement of said first lift to the infeed position at a speed greater than said first speed.

4. The apparatus as set forth in claim 1 wherein said drive control means is operative to provide initial upward movement of said first lift from the infeed station at a speed greater than said first speed.

* * * * *